US006532032B2

(12) United States Patent
Dunham et al.

(10) Patent No.: US 6,532,032 B2
(45) Date of Patent: Mar. 11, 2003

(54) PRINTER USING THERMAL PRINTHEAD

(75) Inventors: Matthew K. Dunham, Eagan, MN (US); Robert E. Francis, Richfield, MN (US); Jon Ibs, Minneapolis, MN (US); Gary M. Klinefelter, Eden Prairie, MN (US)

(73) Assignee: Fargo Electronics, Inc., Eden Prairie, MN (US)

( * ) Notice: Subject to any disclaimer, the term of this patent is extended or adjusted under 35 U.S.C. 154(b) by 0 days.

(21) Appl. No.: 09/792,300

(22) Filed: Feb. 23, 2001

(65) Prior Publication Data

US 2002/0036685 A1 Mar. 28, 2002

Related U.S. Application Data

(63) Continuation-in-part of application No. 09/306,860, filed on May 7, 1999.

(51) Int. Cl.[7] ..... B41J 2/315

(52) U.S. Cl. ..... 347/171

(58) Field of Search ..... 347/171, 185, 347/188, 192, 196, 209; 358/446, 455; 400/120.08, 120.09, 120.11, 120.12, 120.17, 120.01, 120.07, 120.03, 120.04

(56) References Cited

U.S. PATENT DOCUMENTS

| | | | | |
|---|---|---|---|---|
| 4,071,849 | A | 1/1978 | Koyano et al. | 346/1 |
| 4,168,421 | A | 9/1979 | Ito | 219/216 |
| 4,284,876 | A | 8/1981 | Ishibashi et al. | 219/216 |
| 4,300,142 | A | 11/1981 | Kos | 346/76 |
| 4,368,491 | A | 1/1983 | Saito | 358/283 |
| 4,399,749 | A | 8/1983 | Arai | 101/211 |
| 4,464,669 | A | 8/1984 | Sekiya et al. | 346/76 |
| 4,475,114 | A | 10/1984 | Koyama et al. | 346/76 |
| 4,679,055 | A | 7/1987 | Inui et al. | 46/76 |
| 4,701,811 | A | 10/1987 | Moriguchi et al. | 358/298 |
| 4,709,149 | A | 11/1987 | Takahashi et al. | 250/317.1 |
| 4,724,446 | A | 2/1988 | Hirahara et al. | 346/76 |
| 4,769,527 | A | 9/1988 | Hart et al. | 219/216 |
| 4,806,950 | A | 2/1989 | Sekine et al. | 347/185 |
| 4,814,891 | A | 3/1989 | Uchiyama et al. | 358/296 |
| 4,845,514 | A | 7/1989 | Mitsushima et al. | 346/76 |
| 4,884,080 | A | 11/1989 | Hirahara et al. | 346/46 |
| 4,888,601 | A | 12/1989 | Inui | 346/76 |
| 4,890,121 | A | 12/1989 | Hirahara et al. | 346/76 |
| 4,899,170 | A | 2/1990 | Izumi | 346/76 |
| 4,910,603 | A | 3/1990 | Hirahara et al. | 358/298 |
| 4,963,884 | A | * 10/1990 | Kiguchi et al. | 347/188 |
| 4,967,283 | A | 10/1990 | Uchiyama et al. | 358/296 |
| 5,081,529 | A | 1/1992 | Collette | 358/80 |
| 5,099,259 | A | 3/1992 | Hirahara et al. | 346/76 |
| 5,120,936 | A | 6/1992 | Shyu et al. | 219/497 |
| 5,126,757 | A | 6/1992 | Yamada | 346/76 |

(List continued on next page.)

OTHER PUBLICATIONS

U.S. patent application No. 09/306,860, entitled "Printer Using Thermal Printhead," filed May 7, 1999.

*Primary Examiner*—John S. Hilten
*Assistant Examiner*—K. Feggins
(74) *Attorney, Agent, or Firm*—Westman, Champlin & Kelly

(57) ABSTRACT

The present invention provides a method of performing a burn cycle in a thermal printer that reduces printhead switching while increasing printing speed and extending printhead life. In the method, data is loaded into a shift register of a thermal printhead to designate resistive elements that are to be enabled and disabled during the burn cycle. Next, the data is latched into a burn register of the printhead and a power supply of the printhead is activated thereby energizing the enabled resistive elements. New data is then loaded into the shift register. After a short burn period has expired, the new data is latched into the burn register. The steps of loading and latching new data are repeated a predetermined number of times, after which the power supply is deactivated to complete the burn cycle.

6 Claims, 3 Drawing Sheets

U.S. PATENT DOCUMENTS 5,170,179 A 12/1992 Chen et al. ..... 346/76
5,175,635 A 12/1992 Yamada et al. ..... 358/467
5,210,547 A * 5/1993 Watanabe et al. ..... 347/185
5,216,753 A 6/1993 Ng ..... 395/109
5,220,349 A 6/1993 Saita et al. ..... 346/76
5,308,958 A 5/1994 Gassho ..... 219/486
5,309,526 A 5/1994 Pappas et al. ..... 382/56
5,337,258 A 8/1994 Dennis ..... 364/551.01
5,424,767 A 6/1995 Alavizadeh et al. ..... 347/17
5,585,834 A 12/1996 Nagano ..... 347/211
5,636,331 A 6/1997 Klinefelter et al. ..... 395/109
5,669,720 A 9/1997 Negishi et al. ..... 347/180
5,786,837 A * 7/1998 Kaerts et al. ..... 347/190
5,793,403 A 8/1998 Klinefelter ..... 347/195
6,172,688 B1 * 1/2001 Iwasaki et al. ..... 347/2

* cited by examiner

PRINTER USING THERMAL PRINTHEAD

CROSS-REFERENCE TO RELATED APPLICATION

This application claims benefit of U.S. patent application Ser. No. 09/306,860, entitled "PRINTER USING THERMAL PRINTHEAD," filed on May 7, 1999.

FIELD OF THE INVENTION

The present invention is related to thermal printing systems and, more particularly, to a method of reducing printhead switching to increase printing speed and extend printhead life.

BACKGROUND OF THE INVENTION

Thermal printing systems are used to print images on substrates using a thermal printhead and a thermal print ribbon that is positioned between the printhead and the substrate. The printhead is used to heat the thermal print ribbon and cause print material (black or colored) to transfer to the substrate and form the desired image.

The thermal printhead generally includes resistive heating elements, which are uniformly deposited in a single line and are positioned closely together, typically with a resolution of 200 or 300 resistive elements per inch. Each of the resistive elements corresponds to individual pixels of an image line, several of which are printed to form the image. A strobe signal, generated by a controller, switches a power supply that applies a current to the resistive elements, which are enabled in accordance with data that is latched into a burn register of the printhead. The current energizes the enabled resistive elements causing them to heat the thermal print ribbon. This process of energizing the resistive elements is generally part of a burn cycle, at least two types of which are used to print an image line. These include a pre-burn cycle and a print material transfer burn cycle.

The pre-burn cycle is first performed to preheat the resistive elements to a threshold level, above which print material from the thermal print ribbon begins to transfer to the substrate. The print material transfer burn cycle is performed to heat enabled resistive elements beyond the threshold level to thereby cause print material to transfer from the thermal print ribbon to the substrate. These burn cycles involve first loading (clocking) data into a shift register of the printhead, latching the data into the burn register to enable or disable individual resistive elements, and activating the power supply of the printhead to apply current to the enabled resistive elements for a predetermined period of time. Once the pre-determined period of time has expired, the strobe deactivates the power, new data is then loaded into the shift register and latched into the burn register, and the strobe signal reactivates the power to the enabled resistive elements again for another predetermined period of time. This step is repeated numerous times in accordance with the particular type of burn cycle. As a result, the power supply of the printhead is switched several times along with the enabled resistive elements.

This frequent switching of the resistive elements and the power supply is undesirable. Each voltage pulse produced by the power supply causes stress on the resistive elements and the electronics of the printhead, which can cause them to degrade and reduce the operable life span of the thermal printhead. Further, the non-continuous heating of the resistive elements results in a slow printing process. Further still, the amplitude of the voltage and current that is applied to the resistive elements is typically high in order to compensate for heat losses caused by the frequent switching and to increase printing speed. Consequently, these methods of performing a burn cycle in a thermal printer cause significant wear to the thermal printhead.

There exists a need for an improved method of performing a burn cycle that reduces printhead switching while increasing printing speed and extends printhead life.

SUMMARY OF THE INVENTION

The present invention is directed toward a method of performing a burn cycle in a thermal printer that reduces printhead switching, increases printing speed, and extends printhead life. In the method, data is loaded into a shift register of a thermal printhead to designate resistive elements that are to be enabled and disabled during the burn cycle. Next, the data is latched into a burn register of the printhead and a power supply of the printhead is activated thereby energizing the enabled resistive elements. New data is then loaded into the shift register. After a short burn period has expired, the new data is latched into the burn register. The steps of loading and latching new data are repeated a predetermined number of times, after which the power supply is deactivated to complete the burn cycle. The present invention is further directed toward a thermal printer that is adapted to implement the above-describe method.

DETAILED DESCRIPTION OF THE PREFERRED EMBODIMENTS

Figure 1:
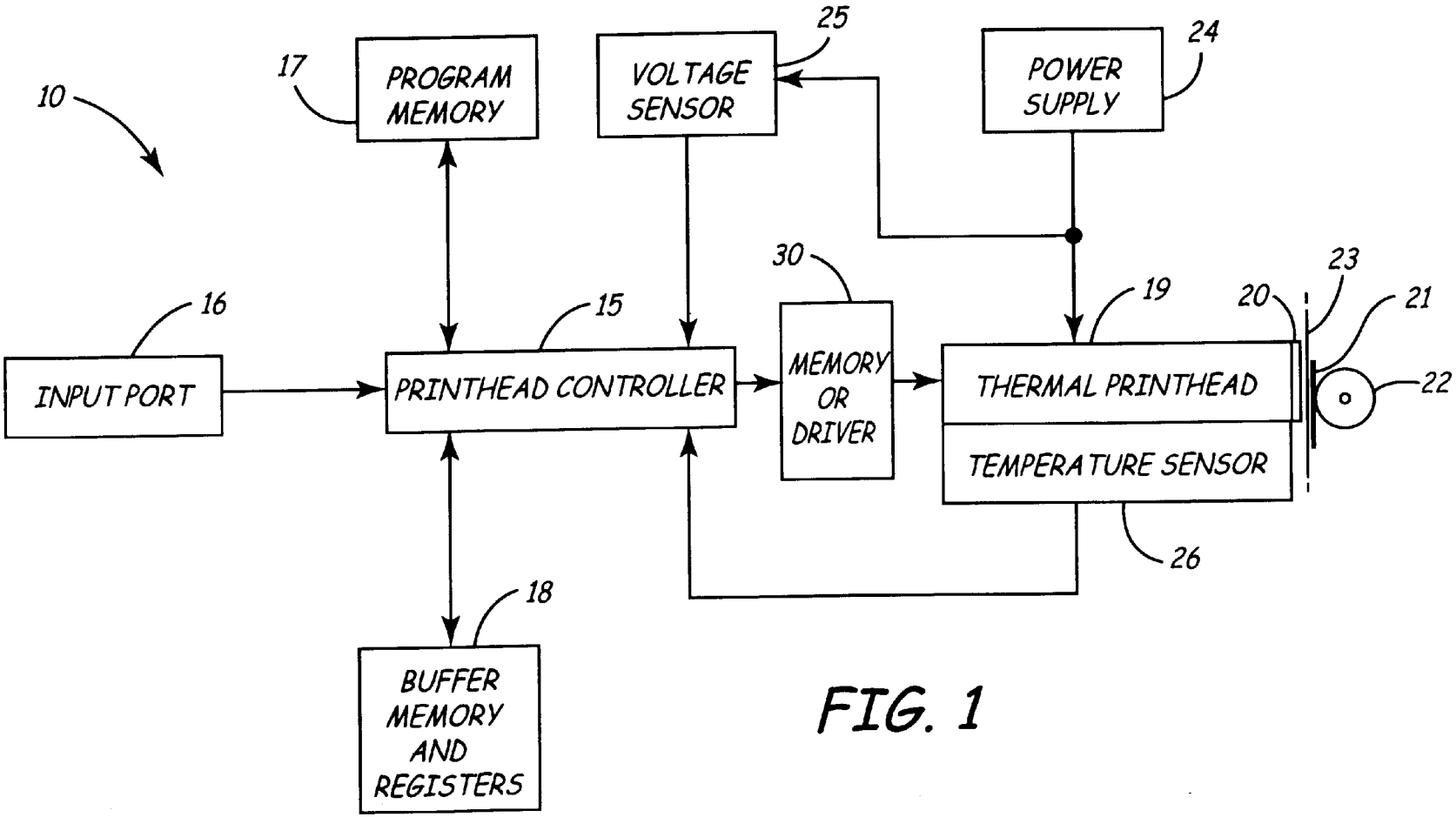
FIG. 1 is a simplified block diagram of a printer, in accordance with embodiments of the present invention.

FIG. 1 is a block diagram of a printer 10 with which embodiments of the present invention may be implemented. A controller (such as a microprocessor) 15 is used to control the printing process. An input port 16 is capable of receiving signals from an output port of, for example, a computer (not shown) and communicates such signals along a bus to controller 15. Controller 15 has a non-volatile program memory 17 and a volatile memory 18. Memory 18 provides both buffer memory and registers for operation of controller 15. Controller 15 operates a thermal printhead 19 having a plurality of resistive elements 20, each of which are used to print a pixel of an image line on a substrate 21. Substrate 21 can be a plastic card used, for example, to make identification cards; a piece of paper; an intermediate transfer film; or other suitable print medium.

Figure 2:
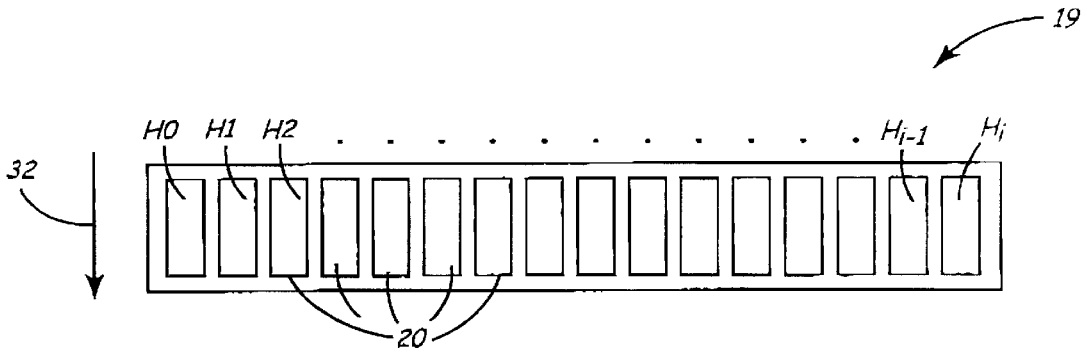
FIG. 2 is a front plan view of a thermal printhead used in the printer of FIG. 1.

FIG. 2 is a diagrammatic view of the active end of a thermal printhead 19 showing resistive elements 20 labeled $H_1$–$H_i$. Here, i is equal to the number of resistive elements 20 on thermal printhead 19, and therefore, is also equal to the number of pixels per image line to be printed on substrate 21. Substrate 21 is advanced past the stationary thermal printhead 19 along with ribbon 23 in the direction identified by arrow 32 shown in FIG. 2. As substrate 21 is advanced, resistive elements 20 print their respective pixel to form the image line on substrate 21. In this manner, thermal printhead 19 prints multiple image lines on substrate 21, which together form a complete image.

During printing or print material deposition, an image line printing signal is loaded (clocked) into a shift register of memory and driver 30 and is provided to thermal printhead 19 using a driver in memory and driver 30. Alternatively, the shift register can be a component of printhead 19. The shift register includes one data register for each resistive element 20 that is capable of storing at least one bit of data. Once the data for the image line is loaded into the shift register it is latched into a burn register of printhead 19. The burn register includes a data register for each resistive element 20. The data in the burn register controls whether a corresponding resistive element 20 will be enabled or disabled during a burn cycle. If enabled, the resistive element will receive current from power supply 24 thereby energizing the enabled resistive element 20 and causing the resistive element 20 to heat thermal print ribbon 23.

Thermal print ribbon 23 can be a dye sublimation, wax-based, or other type of thermally sensitive print ribbon. Thermal print ribbon 23 can include a single color panel for printing a single color of print material such as black, or multi-panel colored ribbons for printing multi-colored print material. Alternatively, thermal print ribbon 23 and substrate 21 can be replaced by a thermally sensitive paper.

Printhead 19 can include a series of integrated circuits (IC's), each responsible for controlling a group or bank of resistive elements 20. One preferred printhead 19, available from Kyocera of Kyoto, Japan, includes 10 such banks of ninety-six resistive elements 20 in each. In one embodiment of the invention, only 8 IC's are used to control a total of 768 resistive elements. In another embodiment, 9 IC's are used to control a total of 864 resistive elements 20. Controller 15 can select whether 8 or 9 banks are used depending upon, for example, the width of the desired image line or the width of substrate 21. The shift register of printhead 19 can be formed of the IC's. Here, each IC includes a data input and a shift register that is capable of carrying one bit of information for each resistive element 20 it controls. As a result, the shift register of printhead 19 can be formed of the shift registers of the IC's. For the eight bank example, the configuration is in accordance with Table 1, where ICO controls any of resistive elements $H_0$–$H_{95}$, IC1 controls any of resistive elements $H_{96}$–$H_{191}$, and so on. For the nine bank configuration, an additional integrated circuit (IC8) would be added to cover resistive elements $H_{768}$–$H_{864}$.

TABLE 1

| IC | RESISTOR (H) |
|---|---|
| IC7 | 672~767 |
| IC6 | 567~671 |
| IC5 | 480~575 |
| IC4 | 384~479 |
| IC3 | 288~383 |
| IC2 | 192~287 |
| IC1 | 96~191 |
| IC0 | 0~95 |

As mentioned above, an image to be printed by printer 10 is generally made up of several image lines, which in turn are formed of individual pixels, each corresponding to a resistive element 20. Controller 15 receives data relating to the image from, for example, a computer, through input port 16. The data generally includes shade level data for each of the pixels that relates to a volume of print material that is to be transferred from ribbon 23 to substrate 21. The shade level data is typically a data byte that is capable of representing 256 individual shade levels for each pixel.

Controller 15 prepares for a burn cycle by comparing the shade level (0–255) of each resistive element 20 (represented by the shade level data byte) with a comparison value. The data registers of the shift register corresponding to resistive elements 20 whose shade level is greater than, or equal to, the comparison value will be loaded with a 1. The data registers of the shift register corresponding to resistive elements 20 whose shade level is less than the comparison value will be loaded with a 0. Ultimately, the data in the shift register will be latched in to the burn register thereby enabling the resistive elements 20 whose corresponding data registers contain a 1 and disabling the resistive elements 20 whose corresponding data registers contain a 0.

In accordance with one aspect of the present invention, controller 15 provides the enabling and disabling bits of data to the shift register of printhead 19 in an efficient manner. For example, controller 15 can provide an output data byte to printhead 19 that includes a bit of data for each of the shift registers of the integrated circuits IC0–IC7 (for eight banks). Thus, each output data byte from controller 15 contains an enabling or disabling data bit corresponding to an individual resistive element 20 that is shifted into each of the shift registers of integrated circuits IC0–IC7. Controller 15 further arranges the order in which the individual bits are presented to integrated circuits IC0–IC7 such that they are clocked into the shift registers in the proper order. Accordingly, a first output byte from controller 15 may contain data bits corresponding to resistive elements $H_0$, $H_{96}$, $H_{192}$, $H_{288}$, $H_{384}$, $H_{480}$, $H_{596}$, and $H_{672}$, which are provided to the corresponding integrated circuit IC0–IC7. The next output byte from controller 15 to integrated circuits IC0–IC7 would then contain data bits corresponding to resistive elements $H_1$, $H_{97}$, $H_{193}$, $H_{289}$, $H_{385}$, $H_{481}$, $H_{597}$, and $H_{673}$. Output data bytes are provided by controller 15 to integrated circuits IC0–IC7 in this manner until all data registers corresponding to each of the resistive elements 20 of the shift registers contain enabling or disabling data bits. Thus, in accordance with this aspect of the present invention, data is arranged such that it is shifted into appropriate integrated circuit or shift register in a highly efficient manner thereby increasing the data transfer rate and allowing for faster printing speeds.

Once the data for each resistive element 20 is loaded into the shift registers of the printhead, a burn cycle is ready to commence. Methods of the prior art of performing a burn cycle were slow, involved frequent switching of power to the resistive elements of the printhead, applied high amplitude currents to the resistive elements, and provided discontinuous shading levels. The method of the present invention improves upon those of the prior art by applying a continuous low-level current to enabled resistive elements 20 while dynamically changing the data that is loaded into the shift register and latched into the burn register of printhead 19. This improves the speed of the printing while only switching the resistive elements 20 once for a particular burn cycle. Moreover, the life of printhead 19 is extended due to the reduced switching and the lower current amplitudes that are applied to the resistive elements 20. In addition, since the power to the resistive elements 20 is provided in a continuous manner rather than the discrete pulses of the prior art, the resulting shades are more continuous than those produce by prior methods.

Figure 3:
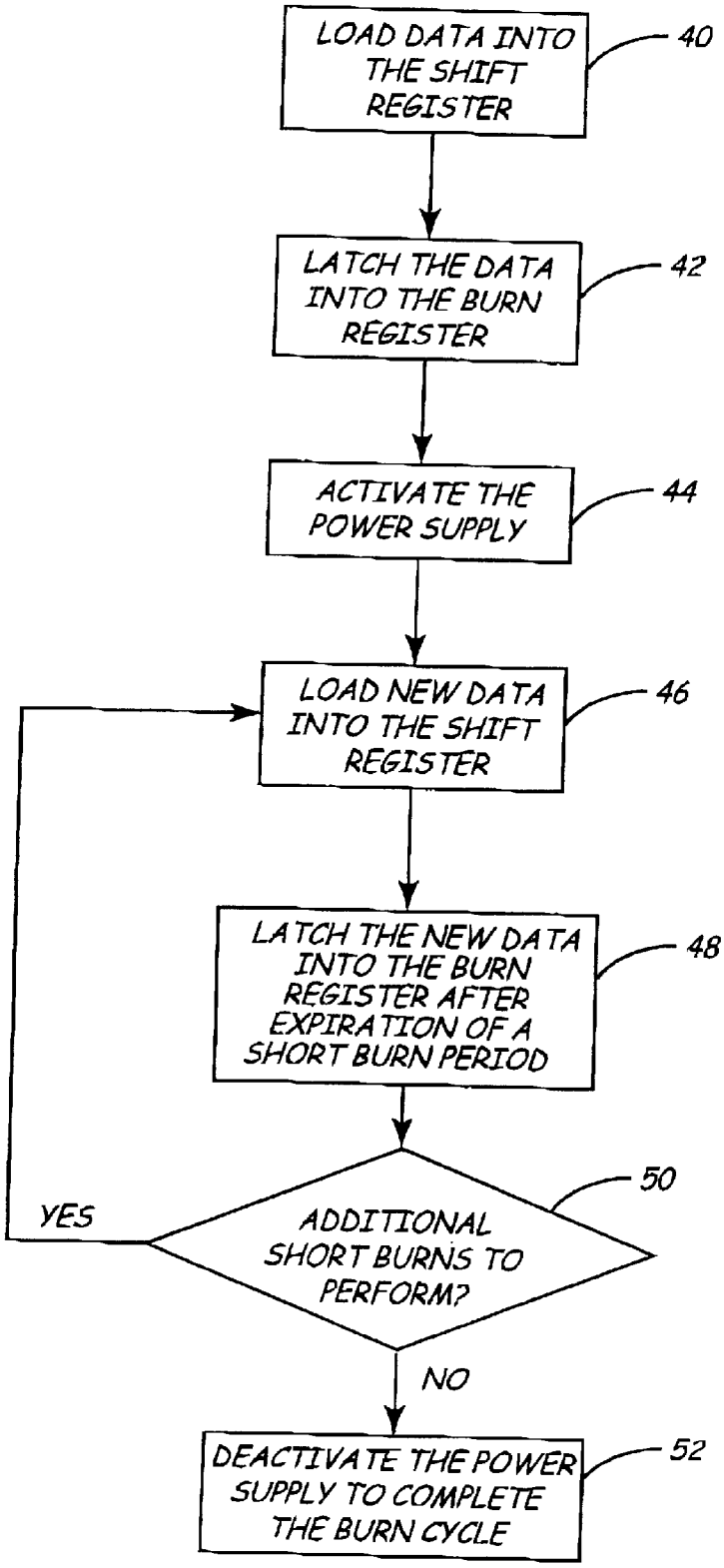
FIG. 3 is a flowchart illustrating a method of performing a burn cycle, in accordance with an embodiment of the invention.

FIG. 3 is a flowchart illustrating a method of performing a burn cycle in accordance with embodiments of the present invention. At step 40, data is loaded into the shift register of printhead 19 and latched into the burn register at step 42. Next, at step 44, a power supply 24 of printhead 19 is activated thereby energizing or providing current to resistive elements 20 that are enabled as designated by the corresponding bits latched in the burn register. The enabled resistive elements 20 produce heat which is used to perform the desired burn cycle. The various types of burn cycles that can be performed will be discussed in greater detail below. At step 46, printhead 19 loads new data received from controller 15 into the shift register. After the expiration of a short burn period, the new data is latched into the burn register, at step 48. The short burn period is defined as a period starting from the moment the data is latched into the burn register and ending when new data is latched into the burn register. At step 50 of the method, steps 46 and 48 are repeated a predetermined number of times as dictated by the particular burn cycle. Finally, the power supply is deactivated at step 52 to complete the burn cycle. As a result, the burn cycle can be completed by switching or energizing the resistive elements 20 only once for the burn cycle.

The short burn period is generally set to an amount of time that is greater than the amount of time necessary for new data to be loaded and latched into the shift register of printhead 19. This is required to allow the power supply 24 of printhead 19 to remain activated during the entire burn cycle. If the short burn period was set to a time that was less than that required to load and latch new data into the shift and burn registers, respectively, the power supply 24 would have to be periodically deactivated until the new data could be latched, thus resulting in the undesirable switching of resistive elements 20.

The short burn period can be dependent upon numerous factors. One such factor is the temperature of resistive elements 20, which can be sensed using temperature sensor 26, shown in FIG. 1. The temperature of resistive elements 20 can be used by controller 15 to adjust the short burn period as needed to maintain shade level accuracy by printhead 19. Another parameter that can be used by controller 15 to determine the proper short burn period, is the number of resistive elements 20 that are to be enabled for the short burn period. In general, when a large number of resistive elements 20 are enabled, the power that is delivered to each resistive element 20 during the short burn period is less than that which would have been provided to the resistive elements 20 if fewer resistive elements 20 were enabled. This loss in power to the resistive elements 20 is compensated by lengthening the short burn period for individual sets of latched data to ensure that each resistive element 20 produces the desired amount of heat.

The short burn period can also be adjusted based upon non-linear characteristics and other properties of ribbon 23. Typically, the volume of print material transferred from thermal print ribbon 23 varies in a non-linear fashion with the temperature of the resistive element 20 and/or the duration that heat is applied by the resistive element 20. As a result, the period of time required for a resistive element 20 to transfer a unit volume of print material to substrate 21 corresponding to an incremental change in the shade level of a pixel may require an adjustment (lengthening or shortening) of the short burn period.

As mentioned above, the method of the present invention can be applied to several different types of burn cycles. These burn cycles generally include a pre-burn cycle and a print material transfer burn cycle. The pre-burn cycle is used to preheat selected resistive elements 20 to raise their temperature to a threshold level, above which print material from ribbon 23 begins to transfer to substrate 21. The print material transfer burn cycle energizes resistive elements 20 to increase their temperature beyond the threshold temperature such that print material is transferred from ribbon 23 to substrate 21.

In one embodiment of the pre-burn cycle, controller 15 operates to reduce power consumption in printhead 19. Here, controller 15 utilizes the width of substrate 21, or the image line to be printed, in determining the number of resistive elements 20 which need to be preheated or pre-burned. For instance, if the substrate 21, or the image line that is to be printed, has a width which is less than the width of the printhead 19 or such that there are resistive elements 20 on printhead 19 which will not be used during the printing process, it is not necessary for those elements to be preheated. This allows for an overall reduction in the power consumption of printhead 19 and reduces the amount of heat generated and latent heat retained in printhead 19. Furthermore, the life of printhead 19 is extended due to the reduction in stress to the resistive elements 20. Further still, because less heat is generated by printhead 19, problems associated with the overheating of ribbon 23, such as wrinkling or other ribbon deformations, are reduced. In accordance with this aspect of the invention, controller 15 either senses the width of substrate 21 or receives information regarding the width of substrate 21 or the width of the image through input port 16 and selectively disables resistive elements 20 that are not required.

As mentioned above, the print material transfer burn cycle is a burn cycle which causes print material to transfer from ribbon 23 to substrate 21. The short burn period for this type of burn cycle represents a period of time that a resistive element 20 is energized in order to cause a unit volume of print material to transfer from ribbon 23 to substrate 21. In one aspect of the invention, the unit volume of print material is sufficient to cover a plurality of pixel shade levels. For example, the short burn period could represent four pixel shade levels and, thus, 64 separate short burn periods would be required to reach the darkest pixel shade level represented by the binary number 255. Ideally, controller 15 is capable of loading new data into printhead 19 at a rate that allows the short burn period to be reduced such that it represents the time required for a volume of print material to be transferred to substrate 21 which causes a single shade level increase. However, due to processing limitations this may not be possible. In that event, small shade level increments (one or two) must be performed during separate burn cycles. Alternatively, dithering techniques, such as that described in U.S. Pat. No. 5,636,331 entitled "Patterned Intensities Printer", which issued on Jun. 3, 1997 to Klinefelter et al., is assigned to the assignee of the present application, and is incorporated herein by reference, can be used to obtain the desired incremental shade levels.

The method used by controller 15 to determine the data that is loaded and latched into the shift register and latched into the burn register of printhead 19, is generally accomplished by comparing the shade level data (data byte representing shade levels of 0–255) for each active resistive element to a comparison value. In general, a data register of the shift register corresponding to a resistive element 20 is set to a binary 1 if the shade level data for the resistive element 20 is greater than or equal to the comparison value. For the pre-burn cycle the comparison value is typically set to 0 to cause all of the active resistive elements 20 having shade levels greater than or equal to 0 to be enabled and, thus, energized such that their temperature reaches the threshold temperature. The comparison value is incremented after the data is loaded into the burn register to determine the resistive elements 20 that will be enabled during the next short burn period. The burn cycle ends when the comparison value reaches a predetermined value set in accordance with the burn cycle.

Although the present invention has been described with reference to preferred embodiments, workers skilled in the art will recognize that changes may be made in form and detail without departing from the spirit and scope of the invention. For example, the pre-burn and print material transfer burns could be combined into a single burn cycle where the resistive elements of the thermal printhead are energized or switched only one time. In addition, the power supply could be activated prior to the initial latching of data into the burn register.

What is claimed is:

1. A method of performing a burn cycle in a thermal printer having a thermal printhead that includes a plurality of resistive elements, a shift register, a burn register whose data designates enabled and disabled resistive elements, and a power supply which energizes the enabled resistive elements when activated, the method comprising:

(a) loading data into the shift register;

(b) latching the data into the burn register;

(c) activating the power supply;

(d) loading new data into the shift register;

(e) latching the new data into the burn register after a short burn period has expired;

(f) repeating steps (d) and (e) a predetermined number of times; and (g) deactivating the power supply.

2. The method of claim 1, including a step (e)(1) of adjusting the short burn period based upon the new data.

3. The method of claim 2, wherein the adjusting step (e)(1) involves extending the short burn period to compensate for reduced power to the enabled resistive elements.

4. The method of claim 2, wherein the adjusting step (e)(1) involves adjusting the short burn period to compensate for properties of the thermal print ribbon.

5. The method of claim 1, wherein the data relates to a burn cycle selected from a group consisting of a pre-burn cycle and a print material transfer burn cycle.

6. A thermal printer, comprising:

a thermal printhead including a plurality of resistive elements;

a shift register including a plurality of data registers each storing data corresponding to one of the resistive elements;

a burn register adapted to receive the data from the shift register, wherein the data designates whether a corresponding resistive element is enabled during a burn cycle;

a power supply having an activated state during which enabled resistive elements are energized and a deactivated state; and a controller adapted to:

a) load data into the shift register;

b) latch the data into the burn register;

c) activate the power supply;

d) load new data into the shift register;

e) latch the new data into the burn register after a short burn period has expired;

f) repeat steps (d) and (e) a predetermined number of times; and g) deactivate the power supply.

* * * * *